US008565624B2

(12) United States Patent
Matsukawa et al.

(10) Patent No.: US 8,565,624 B2
(45) Date of Patent: Oct. 22, 2013

(54) IMAGE FORMING APPARATUS AND PROCESS CARTRIDGE

(75) Inventors: Akihisa Matsukawa, Suntou-gun (JP); Nobuyoshi Yoshida, Suntou-gun (JP)

(73) Assignee: Canon Kabushiki Kaisha, Tokyo (JP)

( * ) Notice: Subject to any disclaimer, the term of this patent is extended or adjusted under 35 U.S.C. 154(b) by 392 days.

(21) Appl. No.: 13/074,573

(22) Filed: Mar. 29, 2011

(65) Prior Publication Data

US 2011/0243580 A1 Oct. 6, 2011

(30) Foreign Application Priority Data

Mar. 31, 2010 (JP) ..... 2010-082826

(51) Int. Cl.
*G03G 15/00* (2006.01)

(52) U.S. Cl.
USPC ..... 399/13; 399/24; 399/27; 399/102; 399/103; 399/106

(58) Field of Classification Search
USPC ..... 399/13, 24, 27, 102, 103, 106
See application file for complete search history.

(56) References Cited

U.S. PATENT DOCUMENTS

2002/0012546 A1* 1/2002 Chanadi ..... 399/106
2003/0161644 A1* 8/2003 Yokoi et al. ..... 399/102

FOREIGN PATENT DOCUMENTS

JP 2003-208002 A 7/2003
JP 2004-061660 A 2/2004

* cited by examiner

*Primary Examiner* — Ryan Walsh
(74) *Attorney, Agent, or Firm* — Canon USA Inc. IP Division

(57) ABSTRACT

An image forming apparatus detects the presence or absence of a toner seal and whether a cartridge is loaded on a main body of the image forming apparatus without use of an additional redundant detection means, due to the provision of an electrically-conductive layer at the toner seal for sealing and closing an opening in a process cartridge including a developer container.

6 Claims, 9 Drawing Sheets

IMAGE FORMING APPARATUS AND PROCESS CARTRIDGE

BACKGROUND OF THE INVENTION

1. Field of the Invention

The present invention generally relates to image forming and, more particularly, to a process cartridge removably loadable on an image forming apparatus, and the image forming apparatus equipped with the process cartridge.

2. Description of the Related Art

Conventionally, image forming apparatuses using the electrophotographic image forming process have employed the process cartridge system, in which a photosensitive drum and a process means are integrally combined into a cartridge so as to be removably loadable onto an image forming apparatus. A process cartridge that includes a development means, and a process cartridge that does not include a photosensitive drum but includes only a development means as a process means (i.e., development cartridge) are provided with a toner seal for sealing and closing an opening of a developer container containing a toner so as to prevent the toner from scattering during, for example, transportation of the cartridge. This toner seal should be removed by the time when image formation is started after the cartridge is loaded on a main body of an image forming apparatus. Only if the seal is pulled out by a user before the cartridge is loaded on an image forming apparatus, the toner can be supplied to a development sleeve.

However, a user may insert the cartridge in an image forming apparatus while forgetting to pull out the toner seal, if the cartridge is configured in such a manner that the cartridge can be loaded on the image forming apparatus even with the toner seal still attached thereto. With the toner seal remaining on the cartridge, the toner is never supplied to a development sleeve, and therefore printing in a print sheet becomes impossible, resulting in a discharge of a blank sheet. If the user does not stay near the image forming apparatus, the user cannot find that he has forgotten to remove the toner seal. As a result, the image forming apparatus may continue discharging blank paper without anything printed thereon.

As a possible solution to solve this problem, there is proposed the method of determining the presence or absence of a toner seal by utilizing electrostatic capacity between a development sleeve and an antenna. Japanese Patent Application Laid-Open No. 2003-208002 discusses that electrical insulation is provided with use of an insulating toner seal to a contact between an antenna configured to output current corresponding to the above-mentioned electrostatic capacity and a detection circuit at a main body of an image forming apparatus. Due to this configuration, the detection circuit outputs a detection result of a zero level when the toner seal is not pulled out, thereby enabling a notification to a user that the user has forgotten to pull out the toner seal. Further, the image forming apparatus can be configured so as to detect a remaining amount of the toner based on the electrostatic capacity between the development sleeve and the antenna, if the toner seal is pulled out.

However, in the invention discussed in Japanese Patent Application Laid-Open No. 2003-208002, the detection circuit also outputs a detection result of a zero level, when the cartridge is not loaded on the main body of the image forming apparatus. Therefore, when the detection circuit outputs a zero-level detection result, it cannot be determined whether this indicates that the cartridge is not loaded on the image forming apparatus or that the toner seal is not removed. Therefore, the image forming apparatus should have another detection means such as a photosensor capable of detecting a protrusion of a cartridge to detect the presence or absence of the cartridge.

SUMMARY OF THE INVENTION

The present invention is directed to a means for determining whether a toner seal is removed, and whether a cartridge is loaded on a main body of an image forming apparatus without use of a redundant detection means.

According to an aspect of the present invention, an image forming apparatus includes a process cartridge which includes a developer bearing member configured to bear and convey a developer and supply it to an image bearing member, a developer container containing an electrically-conductive member therein and including a first chamber for containing the developer and a second chamber where the developer bearing member is disposed and which is in communication with the first chamber through an opening for supplying the developer transferred from the first chamber through the opening to the developer bearing member, and a seal member configured to seal and close the opening before a start of a use and be removed from the opening at the time of the start of the use. The seal member includes, at the opening, an electrically-conductive layer electrically conductive to the developer bearing member when the opening is sealed and closed. The image forming apparatus further includes a support member configured to support the process cartridge in such a manner that the process cartridge is removably loadable thereon, a voltage application unit configured to apply bias voltage containing an alternating-current component to the developer bearing member, a signal generation unit to, upon an application of the bias voltage to the developer bearing member by the voltage application unit, output an electrical signal according to electrostatic capacity between the seal member and the electrically-conductive member if the seal member seals and closes the opening, and output an electric signal according to electrostatic capacity between the developer bearing member and the electrically-conductive member if the seal member is removed from the opening, and a determination unit configured to determine that the process cartridge is not loaded if the signal generation unit outputs the electric signal corresponding to first reference electrostatic capacity or less, and determine that the seal member is not removed if the signal generation unit outputs the electric signal corresponding to second reference electrostatic capacity or more. The second reference electrostatic capacity is greater than the first reference electrostatic capacity.

According to another aspect of the present invention, a process cartridge, which is loadable on a main body of an image forming apparatus, includes a developer bearing member configured to bear and convey a developer and supply it to an image bearing member, a developer container including a first chamber for containing the developer and a second chamber where the developer bearing member is disposed and which is in communication with the first chamber through an opening for supplying the developer transferred from the first chamber through the opening to the developer bearing member, and a seal member configured to seal and close the opening before a start of a use and be removed from the opening at the time of the start of the use. The image forming apparatus includes a support member configured to support the process cartridge in such a manner that the process cartridge is removably loadable thereon, a main body side first contact, a main body side second contact, a main body side third contact, a voltage application unit configured to apply bias voltage containing an alternating-current component to the main body side first contact and the main body side third contact, a signal generation unit configured to output an electric signal with use of current input from the main body side second contact, and a determination unit configured to determine whether the process cartridge is loaded and whether the seal member is removed from the opening based on the electric signal. The process cartridge further includes an electrically-conductive member disposed in the first chamber, a cartridge side first contact configured to be electrically conductive to the developer bearing member and be electrically connected to the main body side first contact when the process cartridge is loaded on the main body of the image forming apparatus, a cartridge side second contact configured to be electrically conductive to the electrically-conductive member and be electrically connected to the main body side second contact when the process cartridge is loaded on the main body of the image forming apparatus, and a cartridge side third contact configured to be electrically connected to the main body side third contact when the process cartridge is loaded on the main body of the image forming apparatus. The seal member includes, at the opening, an electrically-conductive layer and the cartridge side third contact electrically are conducting when the seal member seals and closes the opening. The electrically-conductive member outputs current according to electrostatic capacity between the seal member and the electrically-conductive member if the seal member seals and closes the opening, and current according to electrostatic capacity between the developer bearing member and the electrically-conductive member if the seal member is removed from the opening, from the cartridge side second contact to the main body side second contact, when the bias voltage is applied to the cartridge side first contact through the main body side first contact and to the cartridge side third contact through the main body side third contact.

According to yet another aspect of the present invention, a process cartridge, which is loadable on a main body of an image forming apparatus, includes a developer bearing member configured to bear and convey a developer and supply it to an image bearing member, a developer container including a first chamber for containing the developer and a second chamber where the developer bearing member is disposed and which is in communication with the first chamber through an opening for supplying the developer transferred from the first chamber through the opening to the developer bearing member, and a seal member configured to seal and close the opening before a start of a use and be removed from the opening at the time of the start of the use. The image forming apparatus includes a support member configured to support the process cartridge in such a manner that the process cartridge is removably loadable thereon, a main body side first contact, a main body side second contact, a voltage application unit configured to apply bias voltage containing an alternating-current component to the main body side first contact, a signal generation unit configured to output an electric signal with use of current input from the main body side second contact, and a determination unit configured to determine whether the process cartridge is loaded and whether the seal member is removed from the opening based on the electric signal. The process cartridge further includes an electrically-conductive member disposed in the first chamber, a cartridge side first contact configured to be electrically conductive to the developer bearing member and be electrically connected to the main body side first contact when the process cartridge is loaded on the main body of the image forming apparatus, and a cartridge side second contact configured to be electrically conductive to the electrically-conductive member and be electrically connected to the main body side second contact when the process cartridge is loaded on the main body of the image forming apparatus. The seal member includes, at the opening, an electrically-conductive layer electrically conductive to the developer bearing member when the seal member seals and closes the opening. The electrically-conductive member outputs current according to electrostatic capacity between the seal member and the electrically-conductive member if the seal member seals and closes the opening, or outputs current according to electrostatic capacity between the developer bearing member and the electrically-conductive member if the seal member is removed from the opening, from the cartridge side second contact to the main body side second contact, when the bias voltage is applied to the cartridge side first contact through the main body side first contact.

Further features and aspects of the present invention will become apparent from the following detailed description of exemplary embodiments with reference to the attached drawings.

BRIEF DESCRIPTION OF THE DRAWINGS

The accompanying drawings, which are incorporated in and constitute a part of the specification, illustrate exemplary embodiments, features, and aspects of the invention and, together with the description, serve to explain the principles of the invention.

DESCRIPTION OF THE EMBODIMENTS

Various exemplary embodiments, features, and aspects of the invention will be described in detail below with reference to the drawings.

A first exemplary embodiment of the present invention will be described based on an example in which the image forming apparatus is embodied by a laser beam printer utilizing the electrophotographic process.

Figure 6:
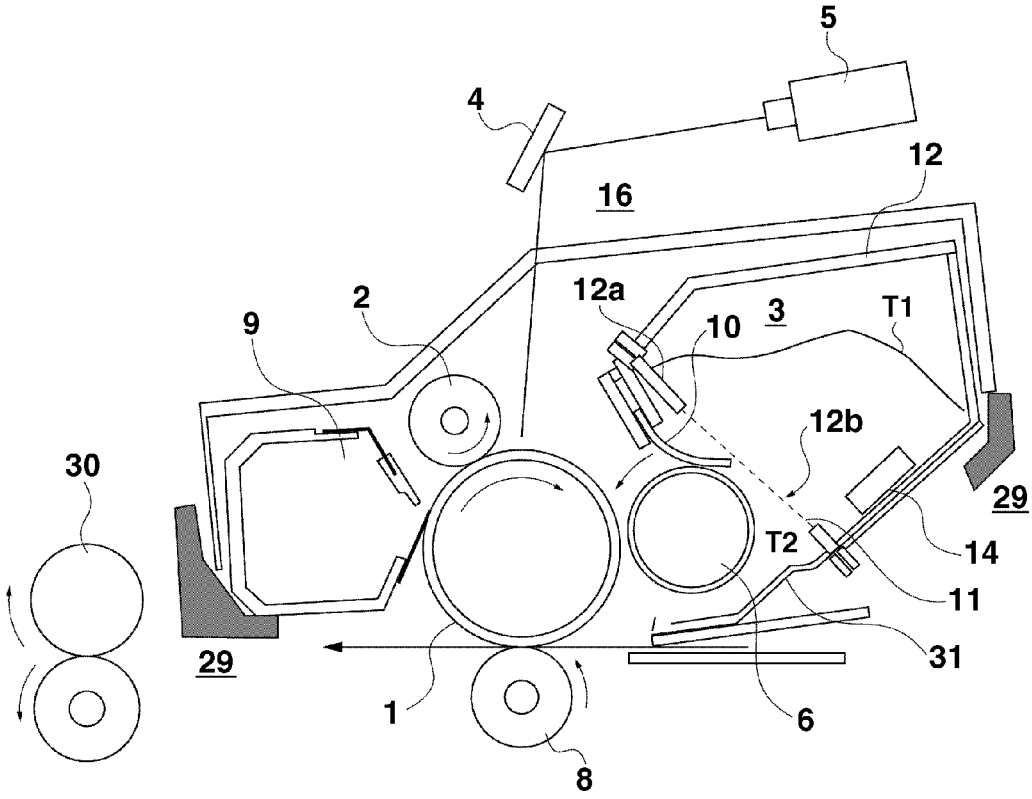
FIG. 6 schematically illustrates a configuration of main parts of the laser beam printer.

FIG. 6 schematically illustrates a configuration of main parts of a laser beam printer according to the present exemplary embodiment. In FIG. 6, a process cartridge 16 is loaded on a printer main body. The process cartridge 16 includes a photosensitive drum 1 as an image bearing member, and three process means, i.e., a charging roller 2 as a contact charging member, a development apparatus 3, and a cleaning apparatus 9. The process cartridge 16 is removably loadable onto a cartridge support base 29 as a support member.

The surface of the photosensitive drum 1 is evenly charged by the charging roller 2 so as to have a predetermined polarity (negative polarity in the present exemplary embodiment) and potential. After that, an electrostatic latent image according to desired image information is generated on the surface of the photosensitive drum 1 by an exposure from a laser scanner 5. A negatively charged toner is supplied to the generated electrostatic latent image by a development sleeve 6 of the development apparatus 3, and then the electrostatic latent image is reversely developed. The development sleeve 6 is energized by predetermined bias voltage containing an alternating-current voltage component. The bias voltage is formed by superimposing and combining alternating-current voltage on direct-current voltage, from a high-voltage power source 20 serving as a voltage application unit. On the other hand, a recording material is conveyed to an abutment nip portion (transfer portion) between the photosensitive drum 1 and a transfer roller 8 in synchronization with the generated toner image on the photosensitive drum 1. The transfer roller 8 energized by predetermined transfer bias voltage from a high-voltage power source (not illustrated). The toner image on the photosensitive drum 1 is transferred onto the recording material. The recording material with the toner image transferred thereon is conveyed to a nip portion of a fixing apparatus 30, and is discharged as an image formed material after the toner image is fixed to the recording material.

When the process cartridge 16 is loaded on the cartridge support base 29, the process cartridge 16 is mechanically and electrically coupled with the printer main body. As a result, a drive mechanism on the printer main body side becomes able to drive the photosensitive drum 1, the development sleeve 6, and others. Further, the power source on the printer main body side becomes able to apply predetermined bias voltage to the charging roller 2, the development sleeve 6, and others.

Next, the development apparatus 3 will be described.

The toner is contained in a toner chamber T1 as a first chamber within a developer container 12. The toner chamber T1 is in communication with a developer chamber T2 as a second chamber defined by a development frame member 31 through an opening 12*b* formed on a partition wall 12*a*. When a use of the process cartridge 16 is started, a toner seal 11 is removed from the opening 12*b*, whereby the opening 12*b* is opened, and the toner in the toner chamber T1 enters the developer chamber T2. In the developer chamber T2, the toner entering from the toner chamber T1 is then supplied to the development sleeve 6. The development sleeve 6 is a rotatable developer bearing member, and includes a magnet fixed therein. In the present exemplary embodiment, the toner is a monocomponent magnetic toner, and therefore is borne by the development sleeve 6 due to the magnetic force of the magnet. Then, the toner is conveyed to a development region where the photosensitive drum 1 and the development sleeve 6 are located opposing each other. The amount of the toner conveyed to the development region is controlled by an elastic blade 10 made from, for example, urethane rubber.

Next, the toner seal 11 as a seal member will be described.

Figure 7:
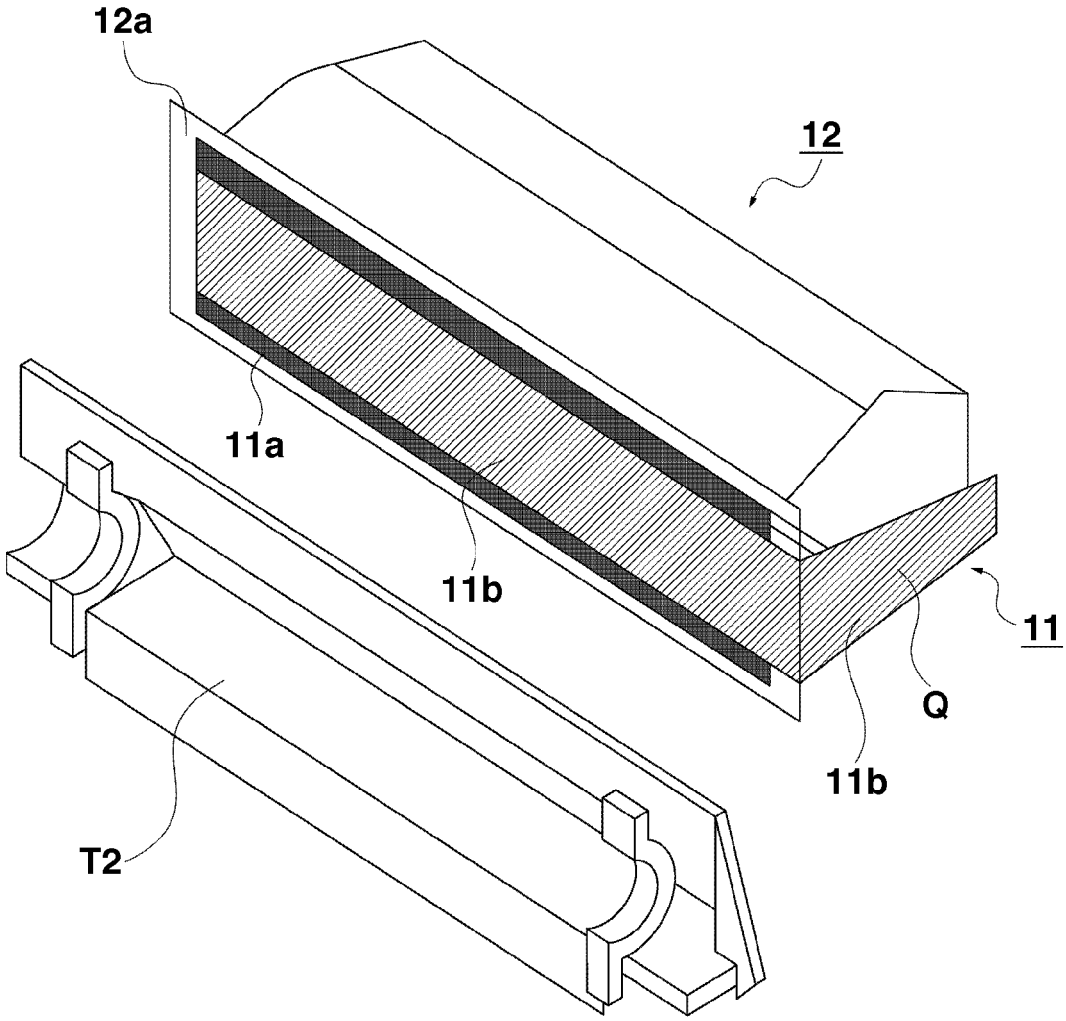
FIG. 7 schematically illustrates a developer container before the toner seal is removed from the developer container.
Figure 8:
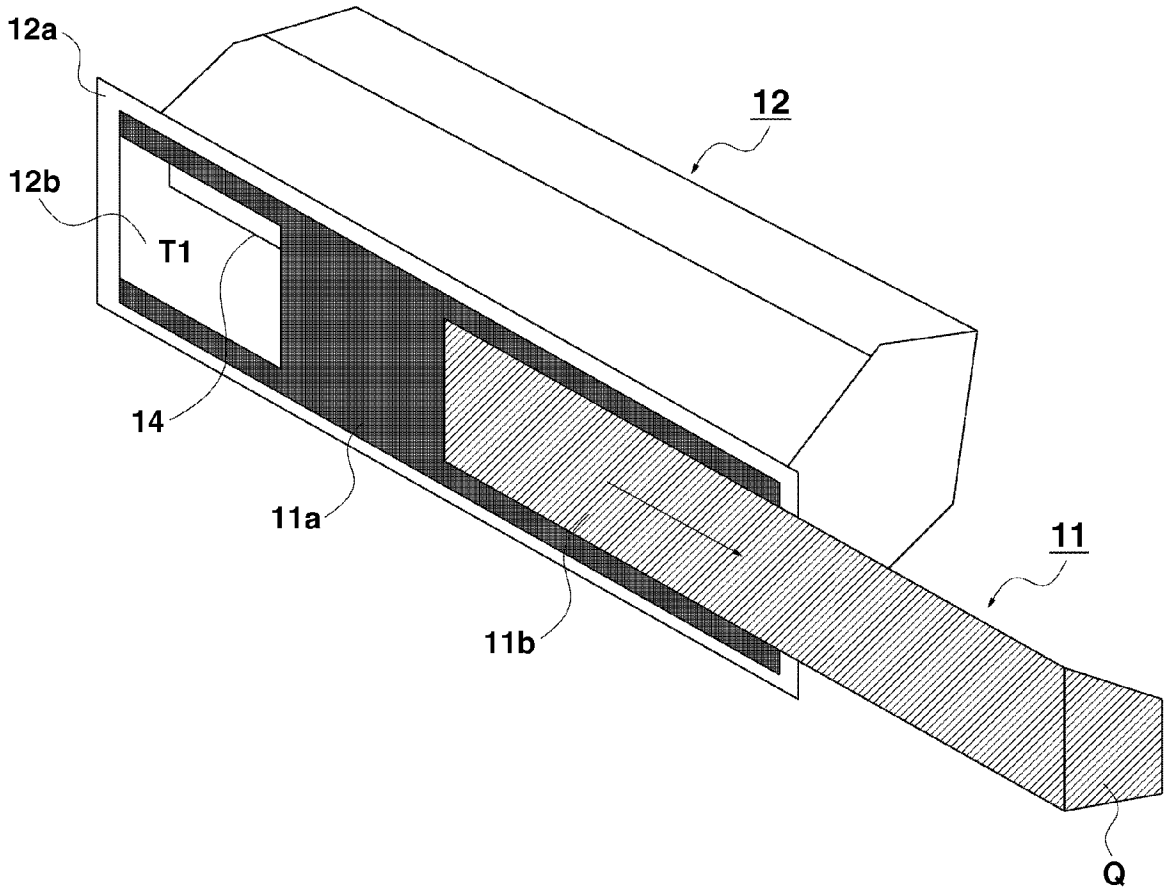
FIG. 8 schematically illustrates the developer container while the toner seal is being removed from the developer container.

FIG. 7 schematically illustrates the developer container 12 before the toner seal 11 is removed from the opening 12*b* prior to a start of a use of the process cartridge 16. The toner seal 11 is constituted by a cover film 11*a* and a tear tape 11*b* bonded to one end of the cover film 11*a*. The cover film 11*a* can seal and contain the toner in the developer container 12 while being thermally bonded to the partition wall 12*a* of the developer container 12 to seal and close the opening 12*b*. On the other hand, the tear tape 11*b* is folded so as to overlap the cover film 11*a*. One of the ends of the tear tape 11*b* that is not bonded to the cover film 11*a* protrudes to the outside of the developer container 12. This protruding portion Q serves as a handle when a user pulls out the toner seal 11 from the process cartridge 16. Although FIG. 7 illustrates the developer container 12 with the development frame member 31 for supporting the development sleeve 6 removed therefrom, actually, the development frame member 31 is thermally attached to the portion outside the toner seal 11 on the partition wall 12*a* of the developer container 12. As illustrated in FIG. 8, when a user pulls the protruding portion Q in the direction indicated by the arrow, the cover film 11*a* is torn into strips, whereby the opening 12*b* is opened.

Figure 9:
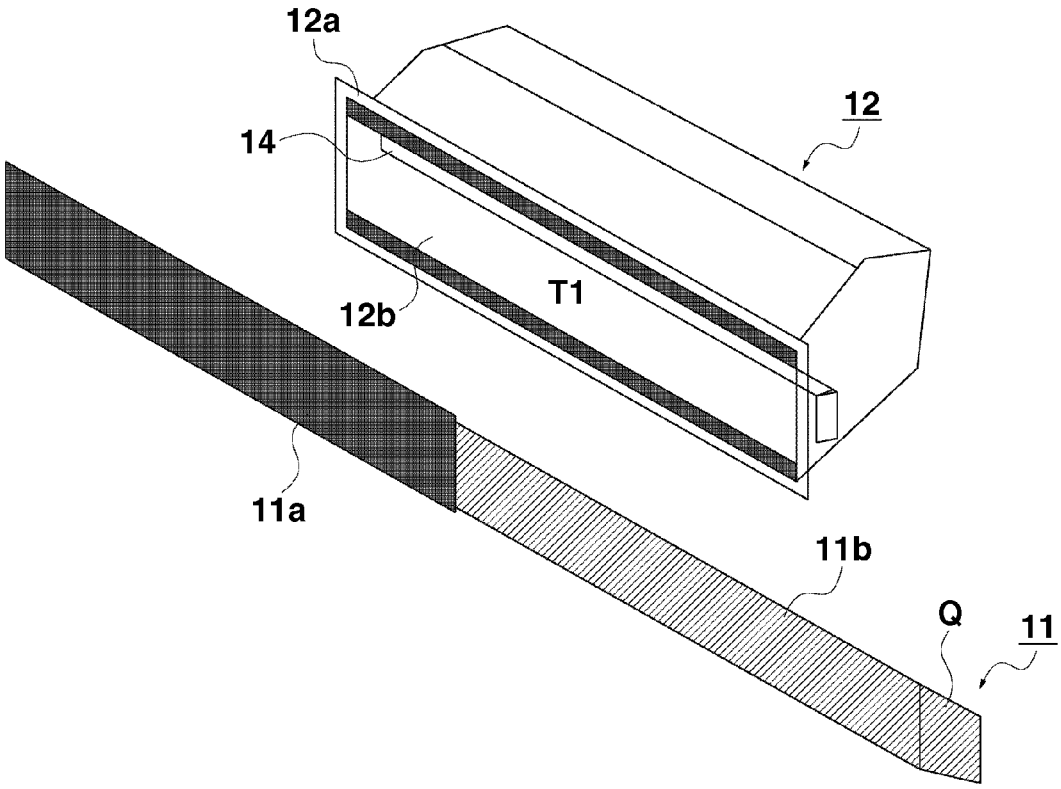
FIG. 9 schematically illustrates the developer container after the toner seal is removed from the developer container.

FIG. 9 schematically illustrates the developer container 12 after the toner seal 11 is pulled out. The toner in the toner chamber T1 passes through the opening 12*b* to enter the developer chamber T2, and then is borne by the development sleeve 6 to be supplied to the photosensitive drum 1.

The toner seal 11 in the present exemplary embodiment is constituted by multiple layers including a polyester layer (layer for maintaining the strength), an aluminum layer, a polyester layer, and a sealant layer (layer for attachment to the container) from the surface layer in this order. When the toner seal 11 is not yet removed, the aluminum layer as an electrically-conductive layer exists at a portion of the toner seal 11 corresponding to at least the opening 12*b*. At least a part of the electrically-conductive layer is exposed on the surface of the toner seal 11, thereby allowing a connection of a conductive wire or the like thereto. The material of the toner seal 1 is not limited thereto, and the electrically-conductive layer of the toner seal 1 may be made of, for example, stainless steel or electrically-conductive plastic, instead of aluminum. Further, the present exemplary embodiment is configured in such a manner that the cover film 11*a* can be torn into strips, but may be configured in such a manner that the cover film 11*a* is completely removed from the partition wall 12*a*.

Next, a detection mechanism, which detects the presence or absence of the process cartridge 16, the presence or absence of the toner seal 11, and the remaining toner amount, will be described.

Figure 1:
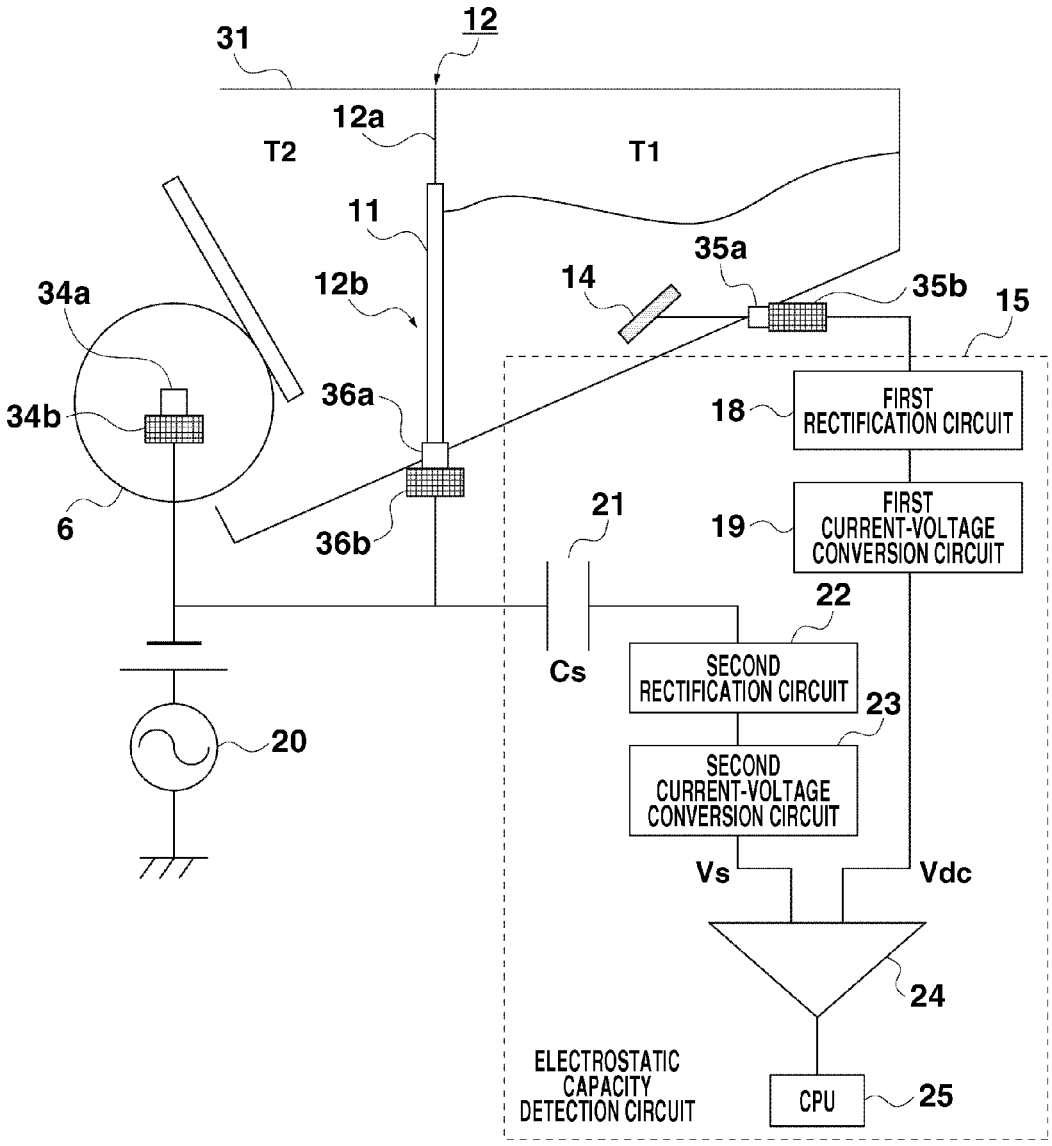
FIG. 1 schematically illustrates a process cartridge and a main body of a printer before a toner seal is removed from the process cartridge according to a first exemplary embodiment.

FIG. 1 schematically illustrates a cross-sectional view of the developer container 12 and a configuration within the printer when the process cartridge 16 with the toner seal 11 still attached thereto is loaded on the cartridge support base 29 of the printer main body. In FIG. 1, the opening 12*b* is sealed and closed by the toner seal 11, and therefore the toner exists only in the toner chamber T1. A sheet metal 14, which is an electrically-conductive member, is disposed within the toner chamber T1. The development sleeve 6, the sheet metal 14, and the electrically-conductive layer of the toner seal 11 and a cartridge side first contact 34*a* are electrically conducting, a cartridge side second contact 35*a*, and a cartridge side third contact 36*a* via, for example, a conductive wire, respectively. When the process cartridge 16 is loaded on the cartridge support base 29, the cartridge side first contact 34*a*, the cartridge side second contact 35*a*, and the cartridge side third contact 36*a* are in electrical contact with a main body side first contact 34*b*, a main body side second contact 35*b*, and a main body side third contact 36*b* of the printer main body, respectively. Bias voltage containing an alternating-current component is applied from the power source 20 disposed within the printer main body to the main body side first contact 34*b* and the main body side third contact 36*b*. Therefore, when the process cartridge 16 before the toner seal 11 is removed therefrom, is loaded on the cartridge support base 29, the cartridge side first contact 34*a* and the cartridge side third contact 36*a* are electrically conducting. In other words, in this state, the electrically-conductive layer of the toner seal 11 and the development sleeve 6 are electrically conducting.

In the present exemplary embodiment, the electrostatic capacity between the toner seal 11 and the sheet metal 14 should be sufficiently greater than the electrostatic capacity between the development sleeve 6 and the sheet metal 14. The electrically-conductive layer may have any area and shape as long as this condition is satisfied.

Figure 2:
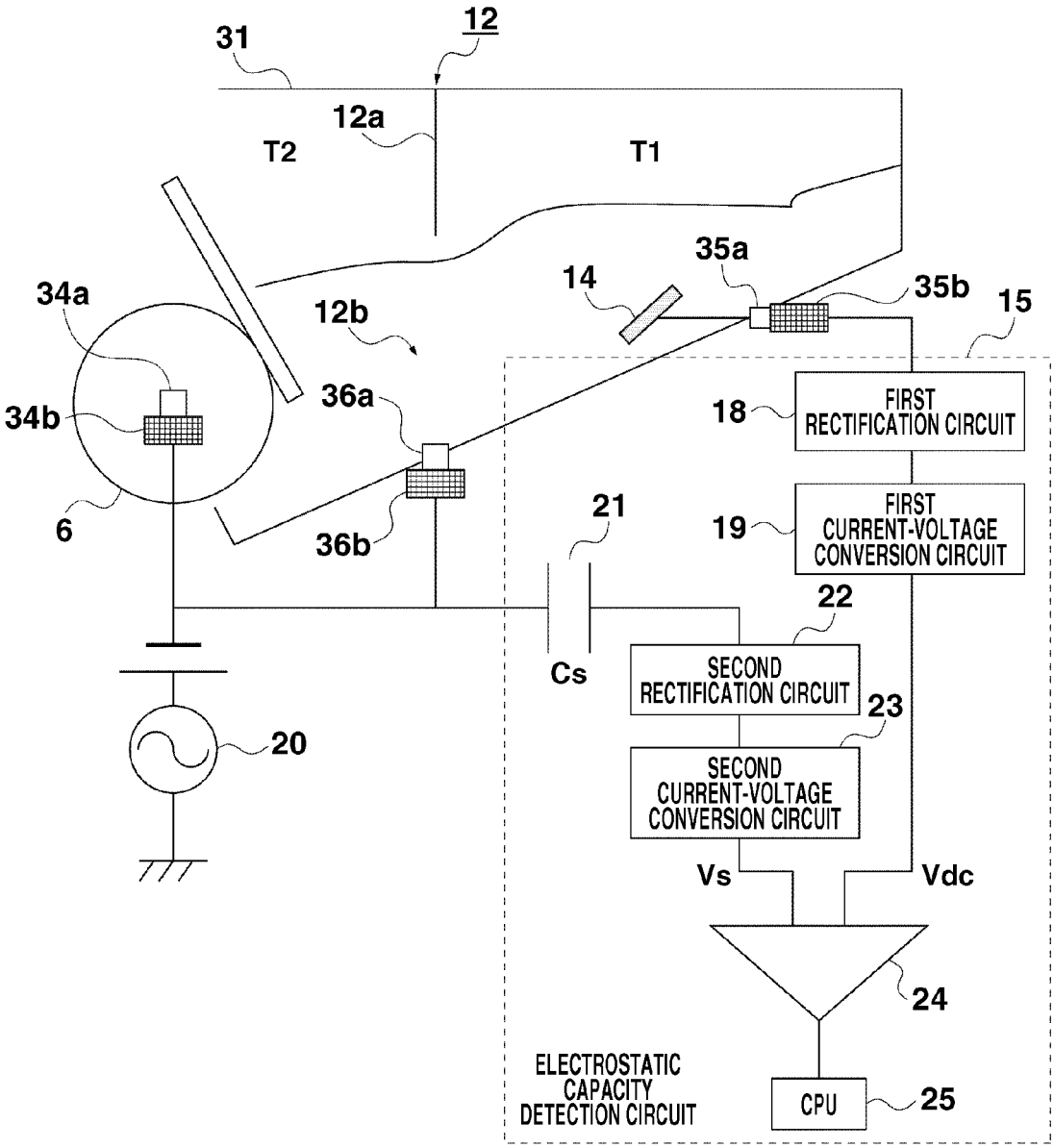
FIG. 2 schematically illustrates the process cartridge and the main body of the printer after the toner seal is removed from the process cartridge according to the first exemplary embodiment.

On the other hand, FIG. 2 schematically illustrates a cross-sectional view of the developer container 12 and the configuration within the printer when the process cartridge 16 with the toner seal 11 removed therefrom is loaded on the cartridge support base 29. The removal of the toner seal 11 from the opening 12*b* establishes communication between the toner chamber T1 and the developer chamber T2, and thereby causes the toner in the toner chamber T1 to enter the developer chamber T2, making the development apparatus 3 ready and usable.

Upon an application of bias voltage containing an alternating-current component from the power source 20 to the development sleeve 6, an electrostatic capacity detection circuit 15 starts to function based on current induced by the sheet metal 14 to detect the presence or absence of the toner seal 11, the presence or absence of the process cartridge 16, and the remaining toner amount in the developer container 12.

In the following, the electrostatic capacity detection circuit 15 will be described in detail. The electrostatic capacity detection circuit 15 includes a first rectification circuit 18 for rectifying current induced by the sheet metal 14, and a first current-voltage conversion circuit 19 for converting a current signal generated at the first rectification circuit 18 into voltage Vdc. The first rectification circuit 18 and the main body side second contact 35*b* are electrically conducting. The electrostatic capacity detection circuit 15 further includes a capacitor 21 connected to the power source 20 in parallel with the development sleeve 6 and having predetermined electrostatic capacity Cs, a second rectification circuit 22 connected to the capacitor 21 in series, and a second current-voltage conversion circuit 23 for converting a current signal generated at the second rectification circuit 22 into voltage Vs. An arbitrary detection level can be set by selecting a capacitor having electrostatic capacity according to a toner amount that a user wants to detect as the capacitor 21. Alternatively, the capacitor 21 may be embodied by a variable capacitor to enable an adjustment of the electrostatic capacity. The electrostatic capacity detection circuit 15 further includes an operational amplifier 24 as a signal generation unit for outputting a difference between the output voltage Vdc from the first current-voltage conversion circuit 19 and the output voltage Vs from the second current-voltage conversion circuit 23, and a central processing unit (CPU) 25 as a determination unit for receiving an output signal from the operational amplifier 24 and determining the signal level of the output signal.

The present exemplary embodiment is configured to convert the current signals generated at the first rectification circuit 18 and the second rectification circuit 22 to voltage, but the present invention is not limited thereto.

Figure 3:
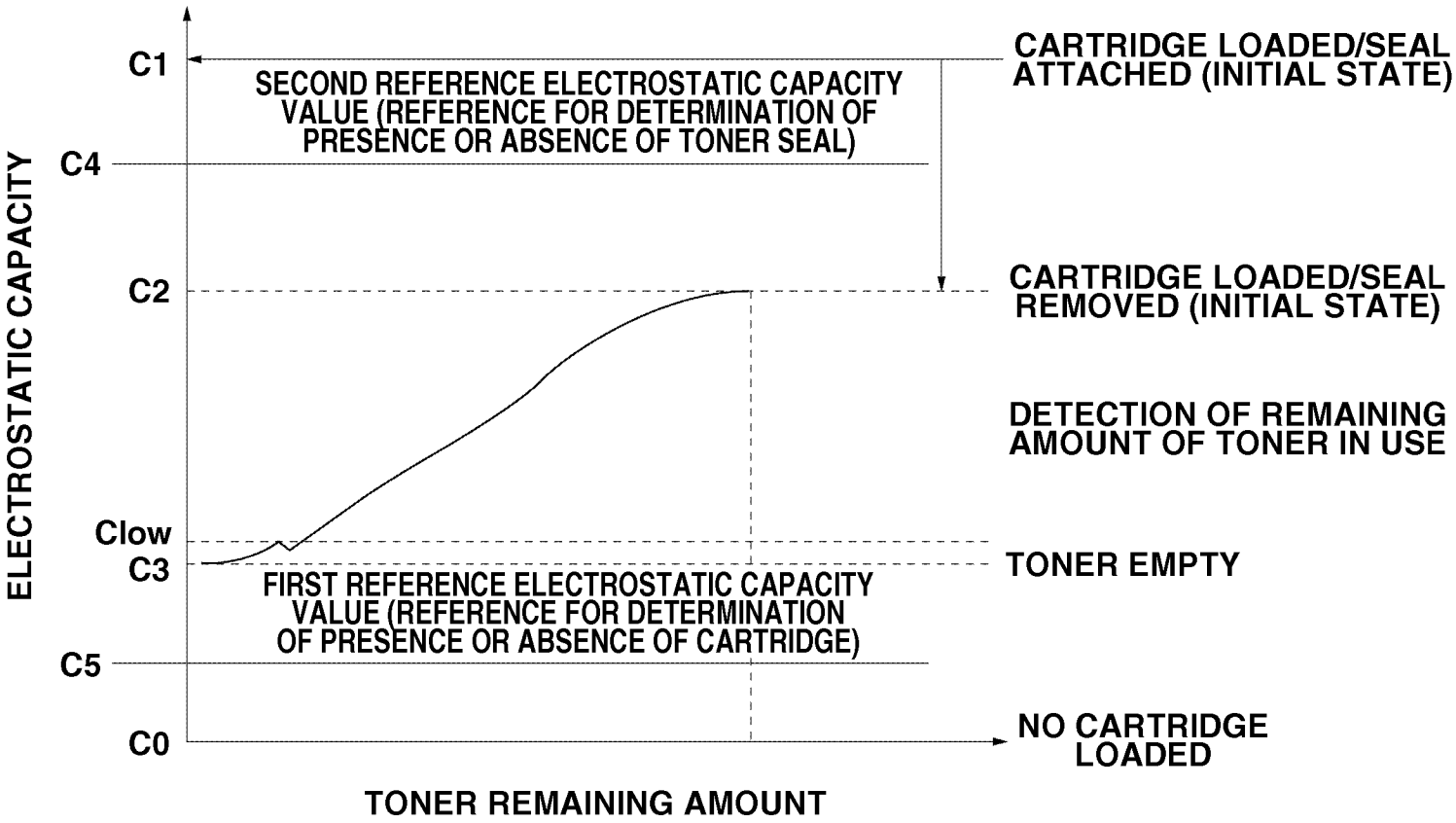
FIG. 3 illustrates the relationship between detected electrostatic capacity and a remaining amount of toner in the first exemplary embodiment.

FIG. 3 illustrates the relationship between the detected electrostatic capacity and the remaining toner amount in the present exemplary embodiment. In the following, a detection method according to the present exemplary embodiment will be described with reference to FIG. 3.

As illustrated in FIG. 2, when the process cartridge 16 with the toner seal 11 removed therefrom is loaded on the printer main body, and bias voltage is applied to the main body side first contact 34*b* and the main body side third contact 36*b*, the operational amplifier 24 outputs a voltage signal according to the amount of electrostatic capacity between the sheet metal 14 and the development sleeve 6. At this time, as the amount of the toner existing between the sheet metal 14 and the development sleeve 6 is increased, the electrostatic capacity between the sheet metal 14 and the development sleeve 6 is increased accordingly. The electrostatic capacity has a largest value C2 when the toner is not consumed at all, and has a smallest value C3 when the toner is completely consumed. The present exemplary embodiment sets electrostatic capacity Clow, which is a slightly greater value than C3 and smaller than C2, as a reference value to notify a user that the remaining toner amount is small. "Clow" is a value corresponding to the remaining toner amount indicating that the remaining toner amount in the developer container 12 is reduced to be significantly small and therefore requiring a notification of this state to a user. If the electrostatic capacity corresponding to a voltage signal output from the operational amplifier 24 is equal to or smaller than Clow, the CPU 25 determines that the remaining toner amount is small, and a warning is displayed on an indicator disposed at, for example, an operational panel of the printer main body.

On the other hand, if the process cartridge 16 is not loaded on the printer main body, the development sleeve 6 and the main body side first contact 34*b* are not electrically conducting, and the sheet metal 14 and the main body side second contact 35*b* are not electrically conducting, even when bias voltage is applied to the main body side first contact 34*b* and the main body side third contact 36*b*. Therefore, at this time, the amount of electrostatic capacity corresponding to the voltage signal output from the operational amplifier 24 is C0, i.e., a zero level, and is significantly smaller than even C3 which indicates that the toner in the developer container 12 is in an empty state. Therefore, the presence or absence of the process cartridge 16 can be determined by setting, as a threshold value, first reference electrostatic capacity C5 so as to be equal to or more than C0 and less than C3. In other words, if the amount of electrostatic capacity corresponding to a voltage signal output from the operational amplifier 24 is equal to or less than C5, the CPU 25 determines that the process cartridge 16 is not loaded on the printer main body.

On the other hand, as illustrated in FIG. 1, when the process cartridge 16 is loaded on the printer main body while the toner seal 11 is not yet removed, the toner seal 11 and the main body side third contact 36*b* are electrically conducting. When bias voltage is applied to the main body side first contact 34*b* and the main body side third contact 36*b*, the operational amplifier 24 outputs a voltage signal according to the electrostatic capacity between the toner seal 11 and the sheet metal 14. At this time, although the electrostatic capacity between the development sleeve 6 and the sheet metal 14 is also included in the voltage signal, this is extremely small and therefore can be ignored. In the state illustrated in FIG. 1, the toner chamber T1 is filled with the toner since the toner seal 11 is not yet removed. When bias voltage is applied to the main body side first contact 34*b* and the main body side third contact 36*b*, the electrostatic capacity C1 corresponding to the voltage signal output from the operational amplifier 24 is greater than C2. Therefore, the presence or absence of the toner seal 11 can be determined by setting, as a threshold value, second reference electrostatic capacity C4 so as to be equal to or more than C2 and less than C1. In other words, if the amount of electrostatic capacity corresponding to a voltage signal output from the operational amplifier 24 is equal to or greater than C4, the CPU 25 determines that the toner seal 11 is not yet removed.

Figure 4:
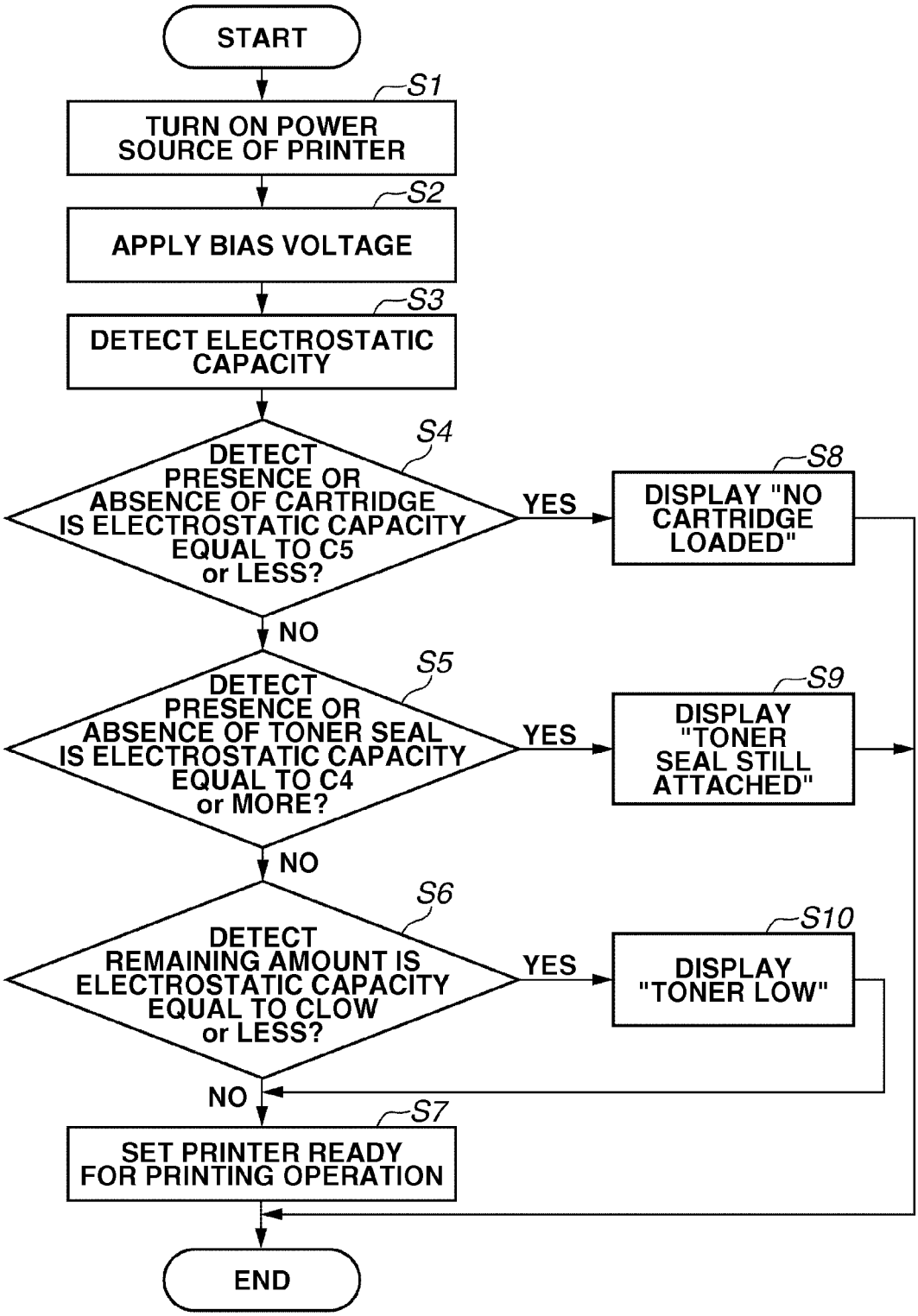
FIG. 4 is a flowchart illustrating a processing flow of detection according to the first exemplary embodiment.

FIG. 4 is a flowchart illustrating a processing flow of detecting the presence or absence of the process cartridge 16, the presence or absence of the toner seal 11, and the remaining toner amount. In the following, the detection processing according to the present exemplary embodiment will be described with reference to FIG. 4.

First, in step S1, the power source of the printer main body is turned on, and then, in step S2, the CPU 25 controls the power source 20 so that bias voltage containing an alternating-current component is applied from the power source 20 to the development sleeve 6. In step S3, the electrostatic capacity detection circuit 15 detects the electrostatic capacity corresponding to the voltage signal output from the operational amplifier 24, and in step S4, the CPU 25 determines whether the detected electrostatic capacity is equal to or less than C5. If the detected electrostatic capacity is equal to or less than C5 (YES in step S4), the processing proceeds to step S8 in which the CPU 25 controls the indicator of the printer main body so that the message "NO CARTRIDGE LOADED" is displayed on the indicator. On the other hand, if the detected electrostatic capacity is greater than C5 (NO in step S4), the processing proceeds to step S5 in which the CPU 25 determines whether the detected electrostatic capacity is equal to or more than C4. If the detected electrostatic capacity is equal to or more than C4 (YES in step S5), the processing proceeds to step S9 in which the CPU 25 controls the indicator of the printer main body so that the message "TONER SEAL STILL ATTACHED" is displayed on the indicator. In this state, the printer cannot perform image formation. On the other hand, if the detected electrostatic capacity is less than C4 (NO in step S5), the processing proceeds to step S6 in which the CPU 25 determines whether the detected electrostatic capacity is equal to or less than Clow. If the detected electrostatic capacity is equal to or less than Clow (YES in step S6), the processing proceeds to step S10 in which the CPU 25 controls the indicator of the printer main body so that the message "TONER LOW" is displayed on the indicator. On the other hand, if the detected electrostatic capacity is more than Clow (NO in step S6), the processing proceeds to step S7 in which the printer is set in a ready state for a printing operation, and it becomes possible to perform image formation.

In the processing illustrated in FIG. 4, when power source of the printer main body is turned on (step S1), the CPU 25 controls the power source 20 to apply bias voltage (step S2). However, the CPU 25 may also control the power source 20 to apply bias voltage when the process cartridge 16 is inserted in the main body while the power source of the printer main body is in an ON state, or when a door (not illustrated) for an insertion or a removal of the process cartridge 16 is closed while the power source of the printer main body is in an ON state.

According to the present exemplary embodiment configured as mentioned above, it is possible to detect the presence or absence of the process cartridge 16 and the presence or absence of the toner seal 11. The present exemplary embodiment is configured to also detect the remaining toner amount in the developer container 12, but may be configured so as to detect only the presence or absence of the process cartridge 16 and the presence or absence of the toner seal 11.

Further, the present exemplary embodiment employs the development sleeve 6 as a developer bearing member, but the present invention is not limited thereto. For example, if a printer is designed to use a non-magnetic toner, bias voltage may be applied to a core metal of a development roller (rubber roller).

Further, the present exemplary embodiment employs, as a cartridge, the process cartridge 16 including the photosensitive drum 1, and three process means, i.e., the charging roller 2, the development apparatus 3, and the cleaning apparatus 9. However, the present invention is not limited thereto, and the cartridge may be embodied by any cartridge including a development apparatus.

Figure 5:
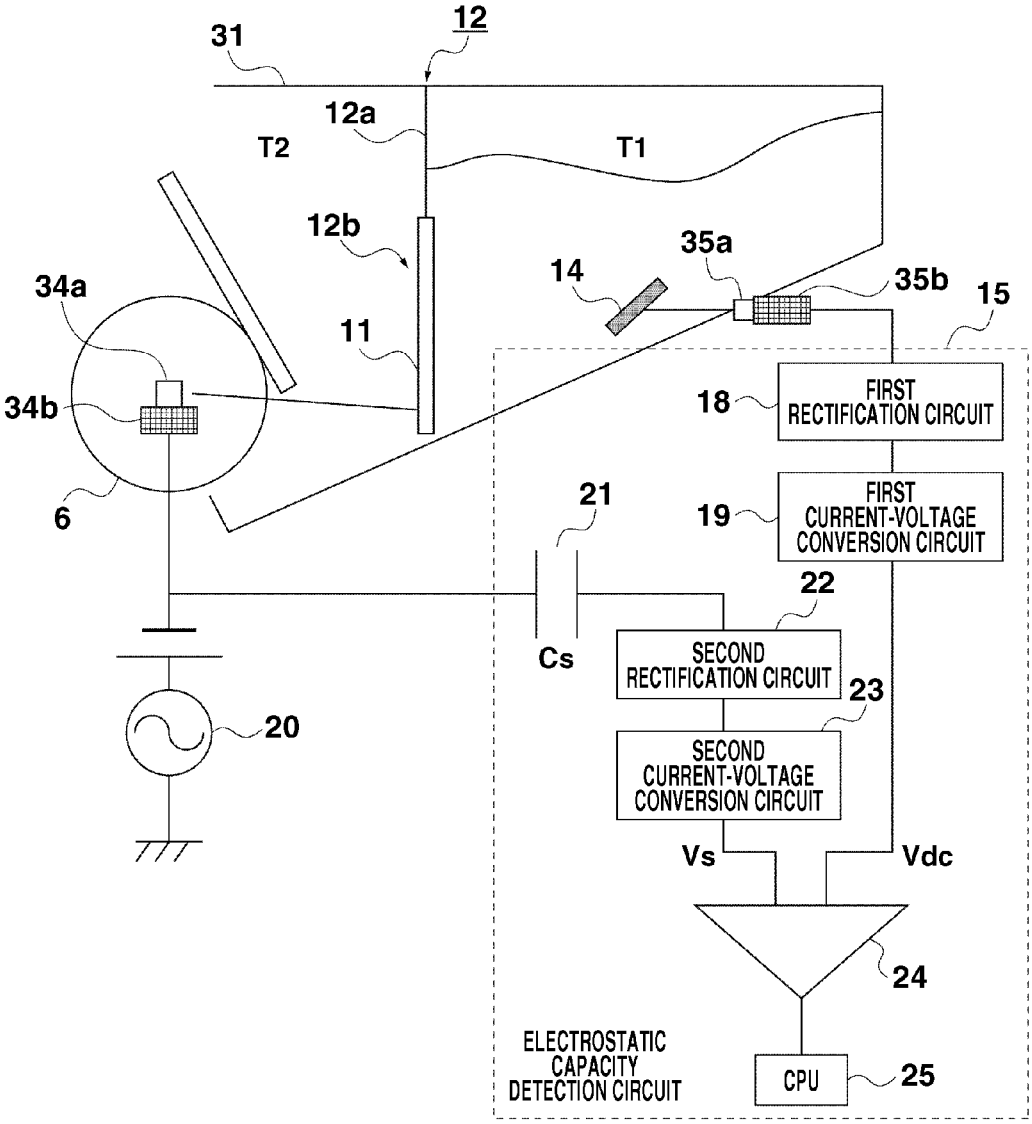
FIG. 5 schematically illustrates a process cartridge and a main body of a printer before a toner seal is removed from the process cartridge according to a second exemplary embodiment.

A second exemplary embodiment is characterized in that the toner seal 11 and the development sleeve 6 are electrically conducting on the process cartridge 16 side. FIG. 5 schematically illustrates a cross-sectional view of the developer container 12 and a configuration within the printer when the process cartridge 16 with the toner seal 11 not yet removed therefrom is loaded on the printer main body. In FIG. 5, the toner seal 11 and the development sleeve 6 are electrically conducting within the development container 12 via, for example, a conductive wire. The present exemplary embodiment does not use the cartridge side third contact 36*a* and the main body side third contact 36*b*. Therefore, the present exemplary embodiment is more advantageous in terms of cost since the number of members can be reduced compared to the first exemplary embodiment.

Also in the present exemplary embodiment, it is possible to detect the presence or absence of the toner seal 11, the presence or absence of the process cartridge 16, and the remaining toner amount within the developer container 12 with use of the electrostatic capacity detection circuit 15.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures, and functions.

This application claims priority from Japanese Patent Application No. 2010-082826 filed Mar. 31, 2010, which is hereby incorporated by reference herein in its entirety.

What is claimed is:

1. An image forming apparatus comprising:

a process cartridge comprising:

a developer bearing member configured to bear and convey a developer and supply it to an image bearing member, a developer container containing an electrically-conductive member therein, and including a first chamber for containing the developer and a second chamber where the developer bearing member is disposed, the second chamber being in communication with the first chamber through an opening for supplying the developer transferred from the first chamber through the opening to the developer bearing member, and a seal member configured to seal and close the opening until a start of a use and be removed from the opening at the time of the start of the use, the seal member including an electrically-conductive layer positioned at the opening, the electrically-conductive layer and the developer bearing member being electrically conducting when the opening is sealed and closed;

a support member configured to support the process cartridge in such a manner that the process cartridge is removably loadable thereon;

a voltage application unit configured to apply bias voltage containing an alternating-current component to the developer bearing member;

a signal generation unit to, upon an application of the bias voltage to the developer bearing member by the voltage application unit, output an electrical signal according to electrostatic capacity between the seal member and the electrically-conductive member if the seal member seals and closes the opening, and output an electric signal according to electrostatic capacity between the developer bearing member and the electrically-conductive member if the seal member is removed from the opening; and a determination unit configured to determine that the process cartridge is not loaded if the signal generation unit outputs the electric signal corresponding to first reference electrostatic capacity or less, and determine that the seal member is not removed if the signal generation unit outputs the electric signal corresponding to second reference electrostatic capacity or more, the second reference electrostatic capacity being greater than the first reference electrostatic capacity.

2. The image forming apparatus according to claim 1, wherein the determination unit determines a remaining amount of the developer within the developer container according to the electric signal if the signal generation unit outputs the electric signal corresponding to the first reference electrostatic capacity or more, and the second reference electrostatic capacity or less.

3. A process cartridge loadable on a main body of an image forming apparatus, the process cartridge comprising:

a developer bearing member configured to bear and convey a developer and supply it to an image bearing member;

a developer container including a first chamber for containing the developer and a second chamber where the developer bearing member is disposed, the second chamber being in communication with the first chamber through an opening for supplying the developer transferred from the first chamber through the opening to the developer bearing member; and a seal member configured to seal and close the opening until a start of a use and be removed from the opening at the time of the start of the use, wherein the image forming apparatus includes a support member configured to support the process cartridge in such a manner that the process cartridge is removably loadable thereon, a main body side first contact, a main body side second contact, a main body side third contact, a voltage application unit configured to apply bias voltage containing an alternating-current component to the main body side first contact and the main body side third contact, a signal generation unit configured to output an electric signal with use of current input from the main body side second contact, and a determination unit configured to determine whether the process cartridge is loaded and whether the seal member is removed from the opening based on the electric signal, and wherein the process cartridge further comprises:

an electrically-conductive member disposed in the first chamber, a cartridge side first contact configured to be electrically conductive to the developer bearing member, the cartridge side first contact being electrically connected to the main body side first contact when the process cartridge is loaded on the main body of the image forming apparatus, a cartridge side second contact configured to be electrically conductive to the electrically-conductive member, the cartridge side second contact being electrically connected to the main body side second contact when the process cartridge is loaded on the main body of the image forming apparatus, and a cartridge side third contact configured to be electrically connected to the main body side third contact when the process cartridge is loaded on the main body of the image forming apparatus, and wherein the seal member includes, at the opening, an electrically-conductive layer electrically conductive to the cartridge side third contact when the seal member seals and closes the opening, and wherein the electrically-conductive member outputs current according to electrostatic capacity between the seal member and the electrically-conductive member if the seal member seals and closes the opening, and current according to electrostatic capacity between the developer bearing member and the electrically-conductive member if the seal member is removed from the opening, from the cartridge side second contact to the main body side second contact, when the bias voltage is applied to the cartridge side first contact through the main body side first contact and to the cartridge side third contact through the main body side third contact.

4. The process cartridge according to claim 3, wherein the determination unit determines that the process cartridge is not loaded if the signal generation unit outputs the electric signal corresponding to first reference electrostatic capacity or less, and determines that the seal member is not removed if the signal generation unit outputs the electric signal corresponding to second reference electrostatic capacity or more, the second reference electrostatic capacity being greater than the first reference electrostatic capacity.

5. A process cartridge loadable on a main body of an image forming apparatus, the process cartridge comprising:

a developer bearing member configured to bear and convey a developer and supply it to an image bearing member;

a developer container including a first chamber for containing the developer and a second chamber where the developer bearing member is disposed, the second chamber being in communication with the first chamber through an opening for supplying the developer transferred from the first chamber through the opening to the developer bearing member; and a seal member configured to seal and close the opening until a start of a use and be removed from the opening at the time of the start of the use, wherein the image forming apparatus includes a support member configured to support the process cartridge in such a manner that the process cartridge is removably loadable thereon, a main body side first contact, a main body side second contact, a voltage application unit configured to apply bias voltage containing an alternating-current component to the main body side first contact, a signal generation unit configured to output an electric signal with use of current input from the main body side second contact, and a determination unit configured to determine whether the process cartridge is loaded and whether the seal member is removed from the opening based on the electric signal, and wherein the process cartridge further comprises:

an electrically-conductive member disposed in the first chamber, a cartridge side first contact configured to be electrically conductive to the developer bearing member, the cartridge side first contact being electrically connected to the main body side first contact when the process cartridge is loaded on the main body of the image forming apparatus, and a cartridge side second contact configured to be electrically conductive to the electrically-conductive member, the cartridge side second contact being electrically connected to the main body side second contact when the process cartridge is loaded on the main body of the image forming apparatus, and wherein the seal member includes, at the opening, an electrically-conductive layer electrically conductive to the developer bearing member when the seal member seals and closes the opening, and wherein the electrically-conductive member outputs current according to electrostatic capacity between the seal member and the electrically-conductive member if the seal member seals and closes the opening, or outputs current according to electrostatic capacity between the developer bearing member and the electrically-conductive member if the seal member is removed from the opening, from the cartridge side second contact to the main body side second contact, when the bias voltage is applied to the cartridge side first contact through the main body side first contact.

6. The process cartridge according to claim 5, wherein the determination unit determines that the process cartridge is not loaded if the signal generation unit outputs the electric signal corresponding to first reference electrostatic capacity or less, and determines that the seal member is not removed if the signal generation unit outputs the electric signal corresponding to second reference electrostatic capacity or more, the second reference electrostatic capacity being greater than the first reference electrostatic capacity.

* * * * *